US005955970A

United States Patent [19]

Ando et al.

[11] Patent Number: 5,955,970

[45] Date of Patent: Sep. 21, 1999

[54] ON-BOARD ELECTRONIC DEVICE FOR USE IN ELECTRONIC TOLL COLLECTION SYSTEM

[75] Inventors: Masamiki Ando, Nagoya; Ichiro Yoshida, Takahama; Mitsuhiro Mizutani, Nagoya, all of Japan

[73] Assignee: Denso Corporation, Kariya, Japan

[21] Appl. No.: 09/074,380

[22] Filed: May 8, 1998

[30] Foreign Application Priority Data

May 19, 1997 [JP] Japan ..... 9-128985
Jun. 16, 1997 [JP] Japan ..... 9-158871

[51] Int. Cl.[6] ..... G08G 1/00

[52] U.S. Cl. ..... 340/928; 340/933; 428/916

[58] Field of Search ..... 340/928, 933, 340/937, 550, 549, 571, 426, 573, 543, 545, 568; 109/42; 428/915, 916

[56] References Cited

U.S. PATENT DOCUMENTS

| | | | |
|---|---|---|---|
| 4,338,587 | 7/1982 | Chiappetti | 340/539 |
| 4,675,824 | 6/1987 | Kiyama et al. | 364/464 |
| 5,086,389 | 2/1992 | Hassett et al. | 364/401 |
| 5,101,200 | 3/1992 | Swett | 340/937 |
| 5,204,675 | 4/1993 | Sekine | 340/933 |
| 5,224,430 | 7/1993 | MacPherson | 109/42 |
| 5,287,519 | 2/1994 | Dayan et al. | 395/700 |
| 5,310,999 | 5/1994 | Claus et al. | 235/384 |
| 5,422,473 | 6/1995 | Kamata | 235/384 |
| 5,424,727 | 6/1995 | Shieh | 340/928 |
| 5,428,353 | 6/1995 | Bird | 340/933 |
| 5,440,109 | 8/1995 | Hering et al. | 235/384 |
| 5,451,758 | 9/1995 | Jesadanont | 235/384 |
| 5,554,984 | 9/1996 | Shigenaga et al. | 340/937 |
| 5,581,249 | 12/1996 | Yoshida | 340/928 |
| 5,640,156 | 6/1997 | Okuda et al. | 340/928 |
| 5,663,548 | 9/1997 | Hayashi et al. | 235/384 |
| 5,705,996 | 1/1998 | Eguchi et al. | 340/928 |
| 5,710,566 | 1/1998 | Grabow et al. | 342/457 |
| 5,757,285 | 5/1998 | Grabow et al. | 340/928 |
| 5,777,565 | 7/1998 | Hayashi et al. | 340/928 |

FOREIGN PATENT DOCUMENTS 6-12589 1/1994 Japan .

*Primary Examiner*—Jeffery A. Hofsass
*Assistant Examiner*—Toan N. Pham
*Attorney, Agent, or Firm*—Pillsbury Madison & Sutro LLP

[57] ABSTRACT

In a toll gate system in which the toll is automatically and electronically collected through wireless communication between an on-board electronic device and a stationary electronic device installed at the toll gate, illegitimate or fraudulent actions committed in the system are detected by the on-board device. When such actions are detected, a communication function of the on-board device is made inoperative. After disposing the illegitimate actions properly, the communication function of the on-board device is restored so that the on-board device can be used again thereafter. The illegitimate action such as opening the on-board device for changing or reading the data contained therein can be detected by sensing removal of screws fastening a circuit board to a case of the on-boar device.

16 Claims, 9 Drawing Sheets

STATUS DATA

LOW BATTERY VOLTAGE
EEPROM WRITING ERROR
EEPROM READING ERROR
NO IC-CARD
CARD ERROR
IC-CARD WRITING ERROR
IC-CARD READING ERROR
ON-BOARD DEVICE DIAGNOSIS ERROR
FLAG INDICATING IMPROPER HANDLING
ACCUMULATED NUMBER OF IMPROPER HANDLING
.
.
.
.

ON-BOARD ELECTRONIC DEVICE FOR USE IN ELECTRONIC TOLL COLLECTION SYSTEM

CROSS-REFERENCE TO RELATED APPLICATIONS

This application is based upon and claims benefit of priority of Japanese Patent Applications No. Hei-9-128985 filed on May 19, 1997, and No. Hei-9-158871 filed on Jun. 16, 1997, the contents of which are incorporated herein by reference.

BACKGROUND OF THE INVENTION

1. Field of the Invention

The present invention relates to an electronic toll collection system and more particularly to an on-board electronic device which makes wireless communication with a stationary device installed at a toll gate for electronically collecting a toll.

2. Description of Related Art

Various systems for electronically collecting a toll at a toll gate have been proposed hitherto. An on-board electronic device for this purpose includes functions such as wireless communication with a stationary device installed at a toll gate, data processing, data memory and an information display for a passenger. Also, the on-board device must to include a security system for protecting monetary data stored therein and ensuring legitimate communication with the stationary device. The security system has to include a countermeasure function against any improper or illegitimate handling of the on-board device. Such improper handling must be discovered to quickly, and operation of the system has to be stopped temporarily. Moreover, the system or the on-board device which is temporarily inoperative must to be recovered after a certain measure has been taken against such improper handling. However, no system which satisfactorily performs the desired functions mentioned above has been proposed.

SUMMARY OF THE INVENTION

The present invention has been made in view of the above-mentioned problem, and an object of the present invention is to provide an on-board electronic device in which countermeasures to make it inoperative are taken against the improper or illegitimate handling, and its operation is easily recovered after a removal of the improper handling.

The electronic toll collection system includes a stationary electronic device installed in a toll gate and an on-board electronic device mounted on a vehicle. The toll is automatically and electrically collected through wireless communication between the on-board electronic device and the stationary electronic device. The data to be used in the system including monetary record have to be put under security protection. If illegitimate actions, such as opening the on-board device for changing the record or reading the data or making fraudulent communication in the system, the communication function of the on-board device is temporarily terminated or canceled. The communication function of the on-board device is temporarily terminated by setting a flag in data processing or eliminating data which is necessary for the communication when the illegitimate action is detected by a detector included in the on-board device.

After the illegitimate action is properly disposed, the communication function of the on-board computer is recovered so that the on-board device can be used thereafter. The temporarily terminated communication function is recovered by subjecting the on-board device to a recovery process which resets the flag or restores the eliminated data. The recovery process is carried out using a preset programmer system.

The illegitimate opening of the on-board device can be detected by sensing the removal of screws fastening a circuit board to a case of the on-board device. Each screw constitutes an electrical switch which turns off when the screw is removed from the circuit board. The switch is connected to a processor of the on-board device to detect the removal of the screw. It is necessary sometimes to open the on-board device for the purpose of repair or maintenance. In this case, this action is legitimate and has to be differentiated from the illegitimate opening. For this purpose, the order of the screw removal can be preset. If the screws are removed in an order other than the preset order, such action can be regarded as illegitimate.

To further enhance the security protection, a memory storing data and a microprocessor may be formed in a single chip for eliminating an outside bus line connecting both. This can avoid the possibility of illegitimately reading the data stored by probing the outer bus line.

Other objects and features of the present invention will become more readily apparent from a better understanding of the preferred embodiment described below with reference to the following drawings.

DETAILED DESCRIPTION OF THE PREFERRED EMBODIMENT

Figure 1:
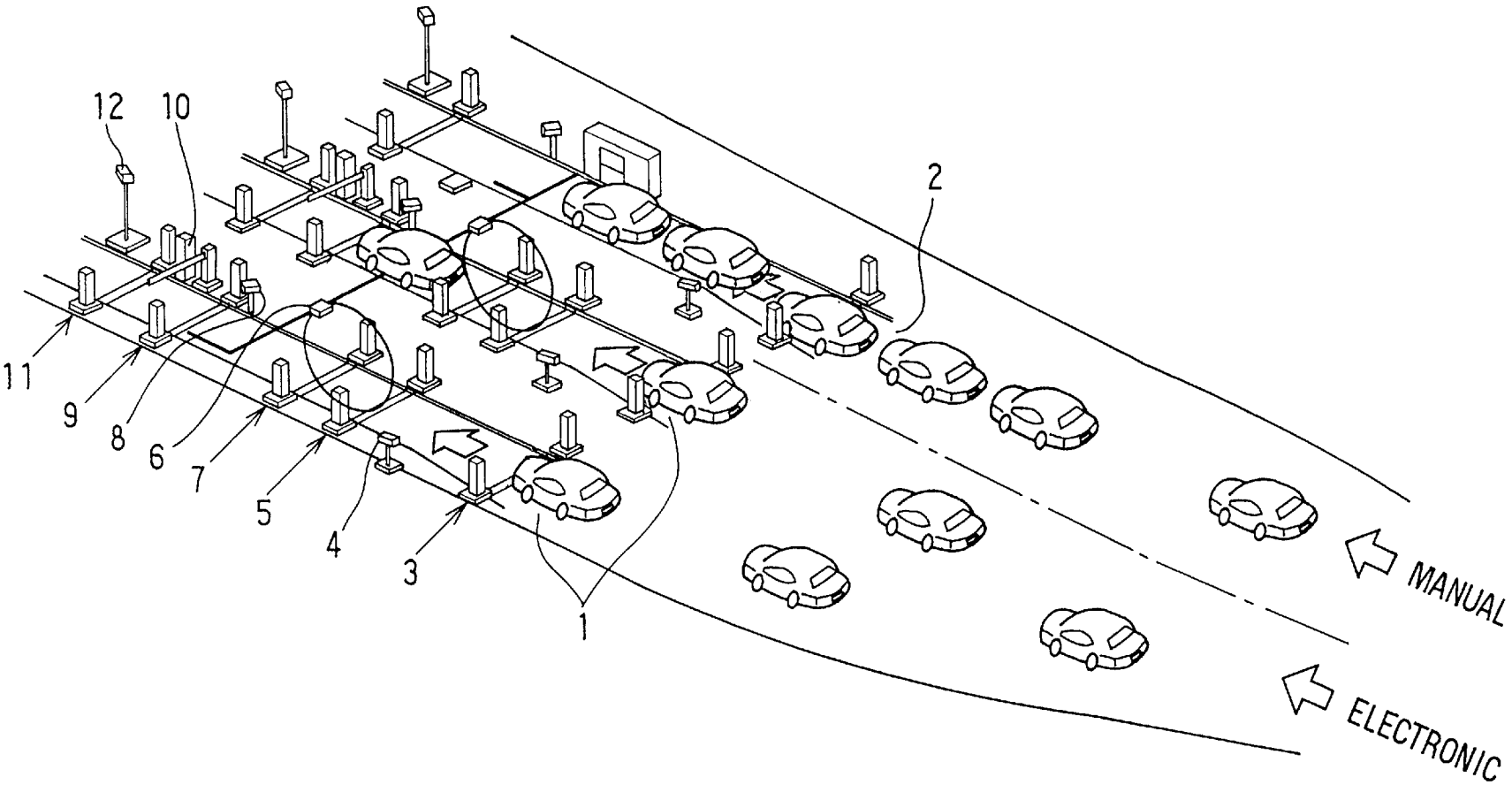
FIG. 1 is a perspective view schematically showing a toll gate where a toll is electronically collected.

Referring to figures, a preferred embodiment according to the present invention will be described. FIG. 1 shows an overview of a toll gate, in which the toll for vehicles passing through the gate is electronically collected in the left two lanes 1 and manually in the right lane 2. In electronic lanes 1, an electronic device on board makes wireless communication with a stationary electronic device installed at the toll gate, and the toll is automatically and electronically collected.

In electronic lanes 1, the following devices are installed on the lane sides, viewing from an entrance of the gate: device 3 for identifying a vehicle class, license plate reader 4, entrance detector 5, road antenna 6, exit detector 7, toll display 8, gate entrance detector 9, ticket issuing machine 10, gate exit detector 11, and watching camera 12. Device 3 identifies the class of a vehicle (a passenger car, a truck or etc.) entering into the gate, and license plate reader 4 reads a license number by a camera. The toll for a vehicle is collected based on these data. Detectors 5 and 7 detect a vehicle and set a timing of communication between the on-board device and the stationary device. Gate entrance detector 9 and gate exit detector 10 set a timing of opening and closing the gate. In case a vehicle having no on-board device enters into electronic lane 1, ticket issuing machine 10 issues a ticket and indicates to proceed to a control office.

Figure 2:
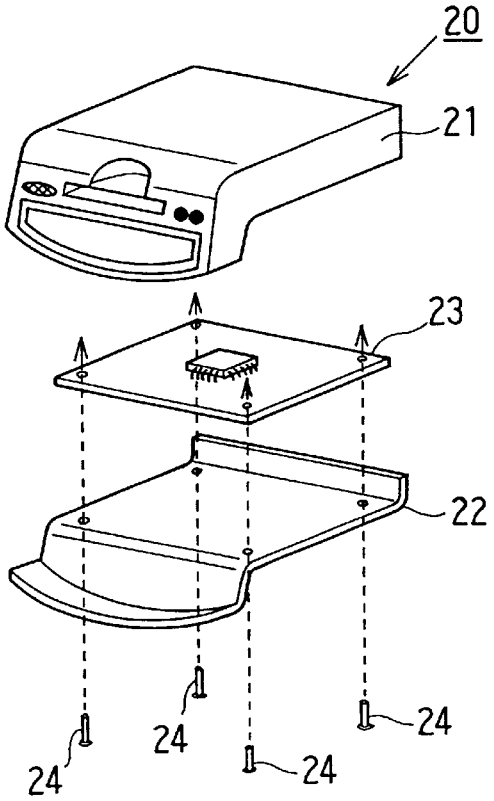
FIG. 2 is a perspective view showing a structure of an on-board electronic device.

FIG. 2 shows a structure of on-board device 20. The on-board device includes upper case 21, lower case 22 and circuit board 23 contained in the cases and assembled by screws 24. On-board device 20 is mounted either on a dash board or inside of a front windshield.

Figure 3:
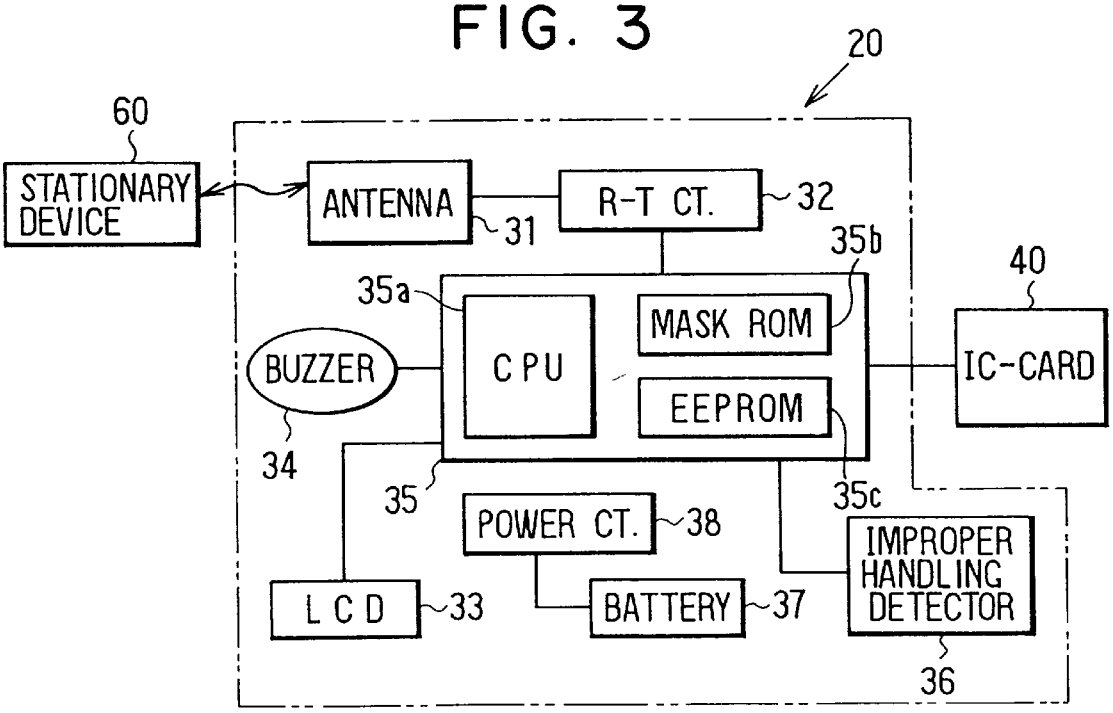
FIG. 3 is a block diagram showing an electronic system in the on-board device.

The structure of on-board electronic device 20 is shown in FIG. 3. The electronic circuit portion thereof is mounted on circuit board 23. On-board device 20 includes antenna 31 for communicating with stationary device 60, receiving-transmitting circuit (R-T Ct.) 32 for performing communication, liquid crystal display (LCD) 33 for displaying information such as a balance of toll accounts and malfunction of the on-board device, buzzer 34 for warning a driver when necessary, and control circuit 35 for controlling the system and processing various data concerning electronic toll payment. When IC-card 40 is inserted into the device, control circuit 35 reads and writes data on IC-card 40 and manages the toll payment. On-board device 20 also includes detector 36 which detects improper handling including illegitimate opening of the case of the device. The illegitimate opening of the case may be discovered by detecting that a wire installed in the case is cut off by opening the case, as shown in JP-A-6-12589, or by using a photo-sensor sensing light when the case is opened. It is also found out by detecting that screws fastening the case are removed, which will be described later in detail. On-board device 20 also includes battery 37 and power source circuit 38 for supplying power to components in on-board device 20.

Figures 4, 5:
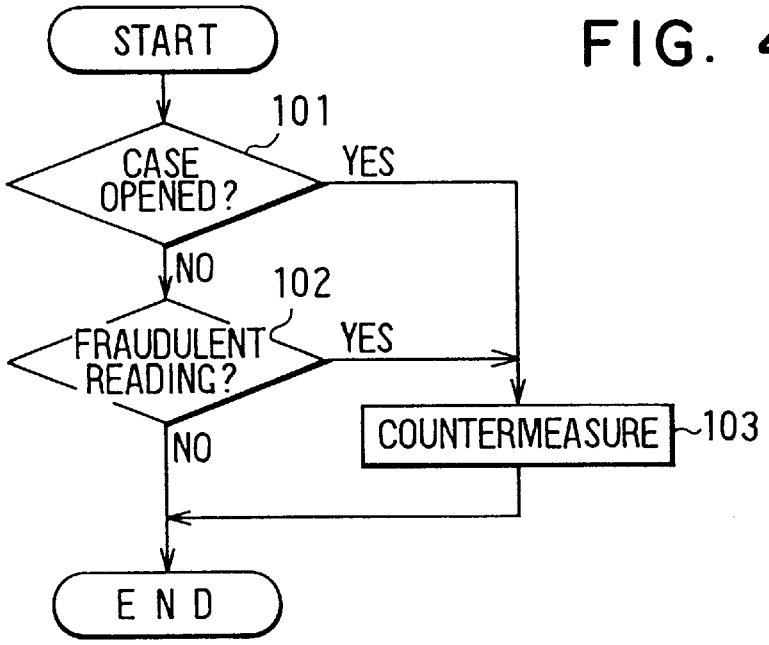
FIG. 4 is a flowchart showing steps for judging improper handling and taking a countermeasure against it.
FIG. 5 is a chart showing status data stored in a memory of the on-board device.

Control circuit 35 includes central processing unit (CPU) for processing data for toll payment and collection, mask ROM 35*b* for storing a data processing program, electronically erasable programmable ROM (EEPROM) 35*c* for storing data such as ID specifying the on-board device as non-evaporative memories. Control circuit 35 processes data for performing the electronic toll collection and for detecting improper or illegitimate handling of the on-board device and taking a countermeasure against it. Control circuit 35 detects the illegitimate opening of the case based on a signal from improper handling detector 36 as shown in FIG. 4. Also, communication between on-board device and stationary device 60 which is carried out in a way that does not conform to a predetermined encrypted code is detected as illegitimate communication.

As shown in FIG. 4, control circuit 35 first judges whether the case of on-board device 20 is illegitimately opened based on the signal from detector 36 (at step 101) and then judges whether the data are illegitimately read by an outsider (at step 102). If either answer from step 101 or 102 is "yes," then the process in control circuit 35 proceeds to step 103 where countermeasures against those illegitimate actions are taken, for example, by setting a flag indicating the improper handling or erasing all the data other than the on-board device ID. When such countermeasures are taken, communication between on-board device 20 and stationary device 60 are made inoperative and the vehicle is judged as an abnormal one. The flag setting as a countermeasure is performed in the following manner. EEPROM 35*c* stores status data including a flag indicating improper handling among others as shown in FIG. 5. When the improper handling is found, the flag included in the status data is set, and thereby the communication is made inoperative and the vehicle which is unable to communicate normally is judged as an abnormal vehicle.

Such a vehicle judged as an abnormal one is directed to proceed to a control office, where some necessary actions are taken, for example, collecting the toll manually and charging a penalty. After such actions are taken at the control office, the on-board device has to be recovered so that it can operate normally next time. The recovery process, when the flag is set as a countermeasure, will be explained referring to FIGS. 6 and 7, and when the data stored in EEPROM are erased, will be explained referring to FIGS. 8 and 9.

Figure 6:
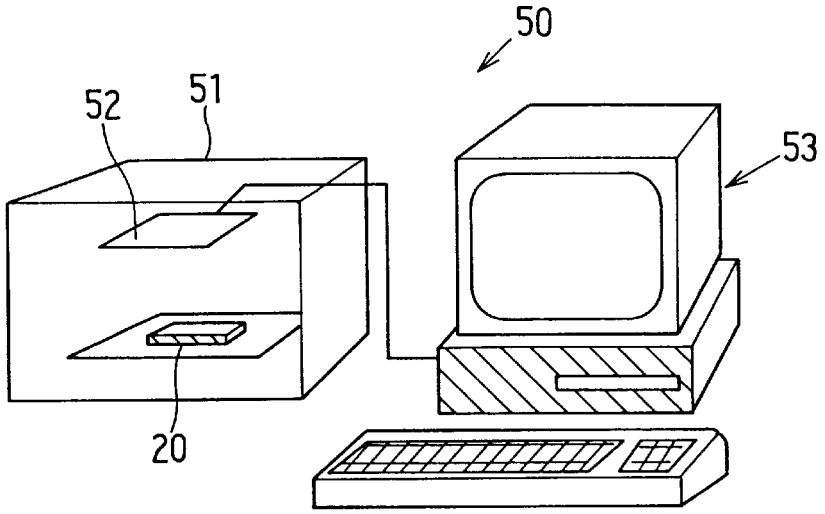
FIG. 6 is a perspective view showing a programmer for resetting the on-board device when a countermeasure to set a flag indicating improper handling is taken.
Figure 7:
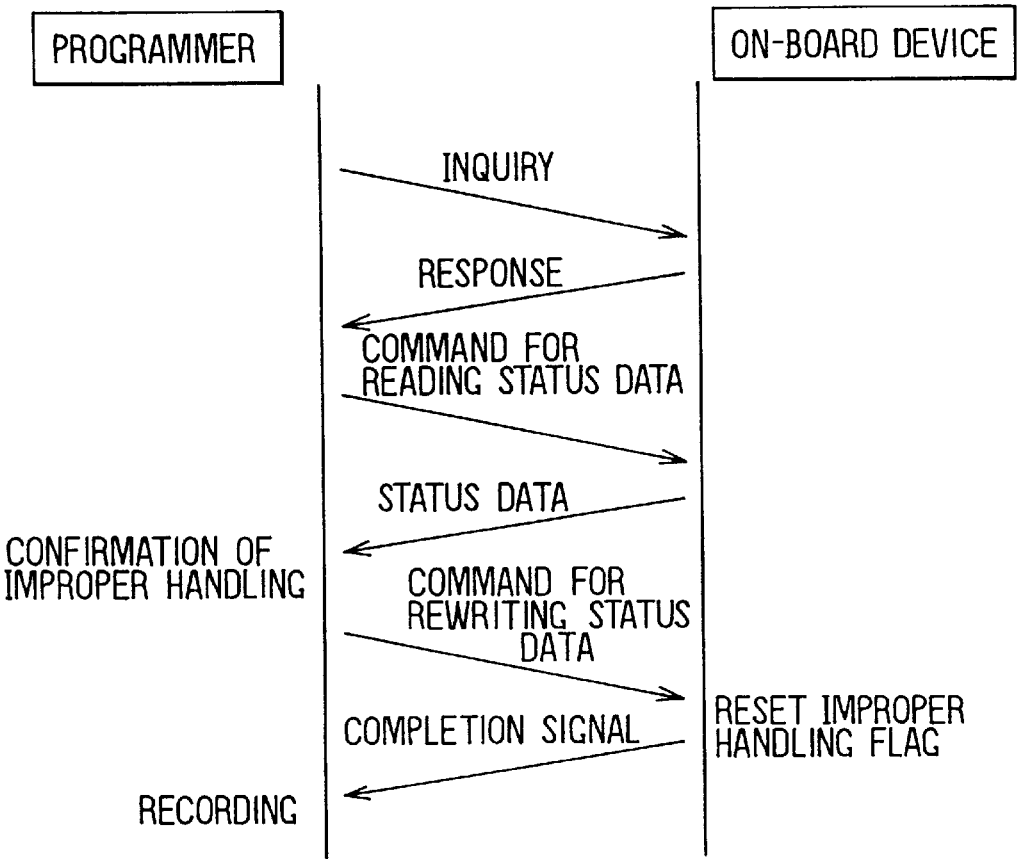
FIG. 7 is a chart showing processes for recovering the function of the on-board device by communication between the programmer shown in FIG. 6 and the on-board device.

Programmer 50 which performs the recovery is shown in FIG. 6. Programmer 50 is composed of electromagnetic shield box 51, antenna 52 contained in shield box 51 and computer 53 for processing recovery steps. On-board device 20 is dismounted from the vehicle and set in shield box 51. Computer 53 wirelessly communicates with on-board device via antenna 52. FIG. 7 shows the recovery process. Computer 53 transmits a query signal to on-board device 20 which in turn sends a response signal encrypted according to a predetermined rule together with the on-board device ID to computer 53. Computer 53 identifies the on-board device 20 based on the encrypted response signal and the ID, and then sends a command to read the status data. On-board device 20 sends back the status data stored therein to computer 53. Computer 53 confirms that the improper handling was committed by recognizing that the flag is set in the status data, and sends a command to reset the flag and to rewrite the number of the improper handling committed heretofore. On-board device 20 which resets the flag and increments the number of commitment, and transmits a signal indicating completion of the recovery process. Finally, computer 53 records the number of commitment together with the on-board device ID. Thus, on-board device 20 which recovers its operability and normal communication with the stationary device is made possible. The number of commitment (incidences) of the improper handling is transmitted to stationary device 60 when on-board device 20 communicates with stationary device 60 next time, and is sent to a host computer from stationary device 60 and recorded in the host computer.

Figure 8:
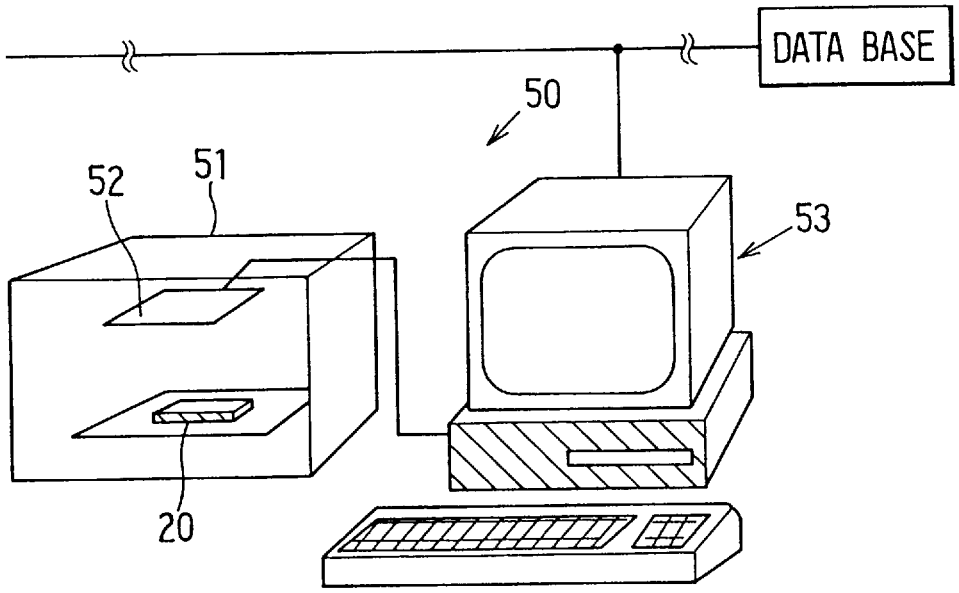
FIG. 8 is a perspective view showing a programmer for recovering the function of the on-board device when a countermeasure to erase data other than ID of the on-board device is taken.
Figure 9:
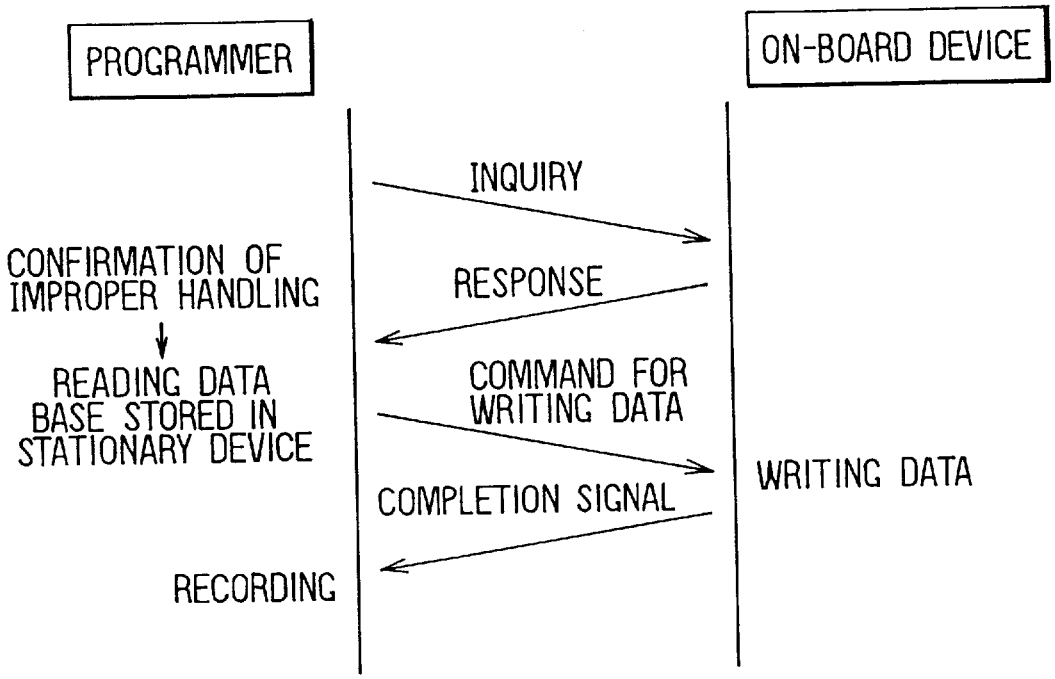
FIG. 9 is a chart showing processes for recovering the function of the on-board device by communication between the programmer shown in FIG. 8 and the on-board device.

The recovery process, when the data other than the on-board device ID is are erased as a countermeasure against the improper handling will be explained, referring to FIGS. 8 and 9. Programmer 50 used in this process is the same as the one described above, except for connection between computer 53 and stationary device 60. Computer 53 in this case is accessed to the data base stored in stationary device 60 so that the data base can be fed to computer 53. As shown in FIG. 9, computer 53 sends a query signal to on-board device 20 which in turn sends back a response signal encrypted according to a predetermined rule together with its own ID. Since the data stored in on-board device 20 has been erased, the signal sent back is not correctly encrypted. Accordingly, computer 53 confirms that improper handling has been committed. Then, computer 53 sends a command to rewrite the data according to such data received from stationary device 60 and to increment by one the number of commitment of the improper handling. On-board device 20 rewrites the data and the number of commitment, and sends a signal indicating completion of the recovery process to computer 53. Computer 53 makes such recording therein and sends it to the host computer together with the on-board device ID. Though all the data except the on-board device IC are erased in the countermeasure described above, it is possible to erase some data (not all) so that the communication with stationary device is performed in error.

Figure 10:
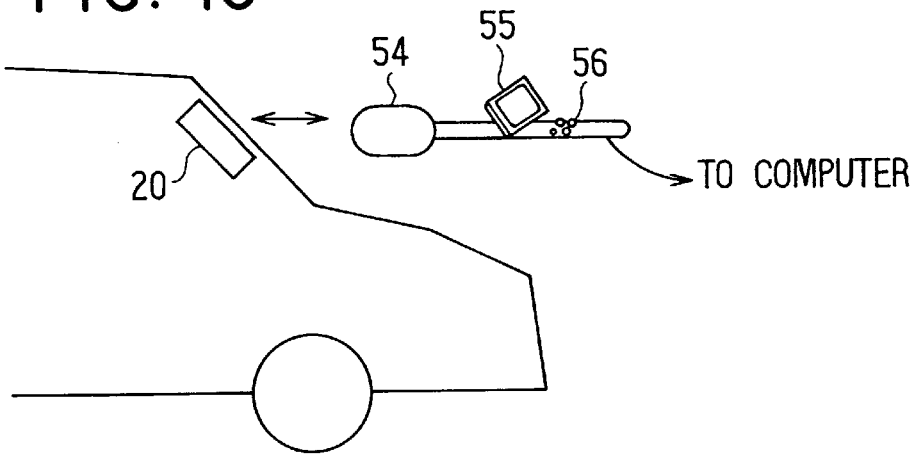
FIG. 10 is a schematic view showing another example of the programmer for recovering the function of the on-board device.
Figure 11B:
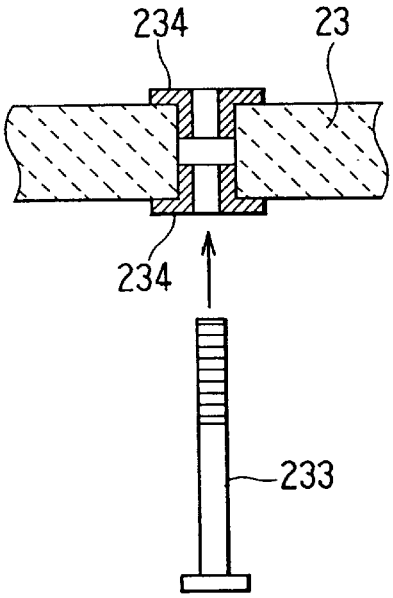
FIG. 11B is a cross-sectional view showing the circuit board with the bushing and a screw for assembling the on-board device.
Figure 11A:
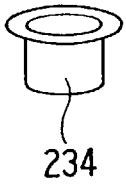
FIG. 11A is a perspective view showing a metallic bushing disposed in a circuit board of the on-board device.

FIG. 10 shows a modified form of programmer 50. This programmer is designed so that it can be easily carried in front of a vehicle. On-board device 20 to be subjected to the recovery process can be processed without being dismounted from the vehicle. Programmer 50 includes antenna 54 for wirelessly communicating with on-board device 20, display 55 and manual switch 56, and is electrically connected to computer 53 containing the system for the recovery process.

As described above, the number of the improper handling committed is recorded every time when the on-board device is subjected to the recovery process. Therefore, fraudulent or illegitimate acts in connection with the toll payment can be effectively controlled, and it is possible to make the on-board device unrecoverable when the accumulated number of improper handling exceeds a certain number. Though IC-card 40 is used for the toll payment in the embodiment described above, it is also possible to use a prepaid system stored in EEPROM 35*c*.

Now, the ways how to detect the illegitimate opening of the case of the on-board device will be described in detail. The on-board device is presumed not to be opened by the user, because it contains monetary data which requires security protection. Therefore, if it is opened illegitimately, such a illegitimate action has to be detected and a countermeasure against it has to be taken. On the other hand, it is sometimes necessary to open the case for the maintenance purpose. It is desirable not to take the countermeasure in case of such a legitimate action, because the on-board device has to be subjected to a recovery process when the countermeasure, which makes the on-board device inoperative, is taken.

Figure 12:
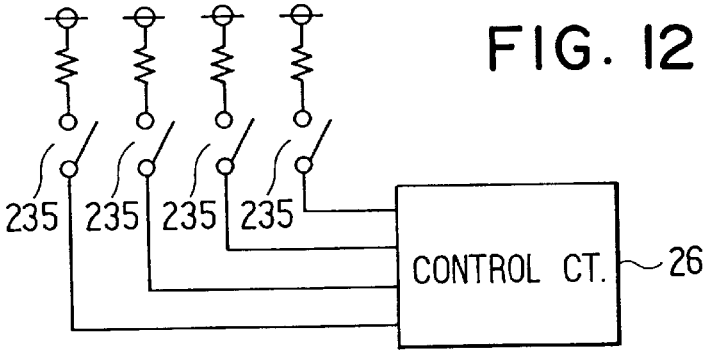
FIG. 12 is a diagram showing a circuit for detecting removal of the screws from the on-board device.

Referring to FIGS. 11A to 14, the way of detecting the illegitimate opening of the case will be described. The on-board device is assembled by four screws as shown in FIG. 2, and the screws are inserted into the holes of circuit board 23. FIG. 11B shows circuit board 23 with metallic bushings 234 inserted into its hole and screw 233. Metallic bushing 234 has a shape shown in FIG. 11A. Screw 233 is made not to be driven by a normal screw driver to reduce the chance of illegitimate action. Two metallic bushings 234 are inserted from an upper surface and a bottom surface of circuit board 23, respectively, with a space therebetween. Two bushings 234 are electrically connected when screw 233 is inserted into bushings 234, and they are electrically disconnected when screw 233 is removed, thereby forming an electric switch. Four screws 233 and bushings 234 form four switches 235 as shown in FIG. 12. Switches 235 are connected to control circuit 26 to detect the removal of screws 233.

Figure 13:
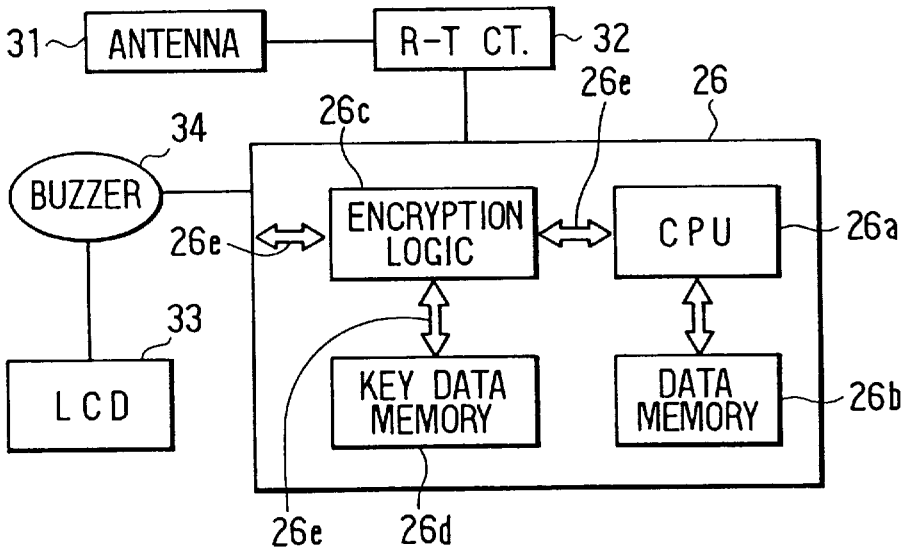
FIG. 13 is a block diagram showing another example of an on-board electronic device.

FIG. 13 is a block diagram showing on-board device 20 which is similar to that shown in FIG. 3. On-board device 20 includes control circuit 26 having CPU 26*a*, data memory 26*b*, encryption logic circuit 26*c* and key data memory 26*d*. CPU 26*a* processes the data for the toll collection and performs the countermeasure against illegitimate acts according to a program stored in a mask ROM (not shown). Data memory 26*b* stores the data such as the ID number of on-board device 20 and a balance of a prepaid toll (when a prepaid card is used). Encryption logic circuit 26*c* encrypts the data from CPU 26*a* and decodes encrypted data sent from stationary device 60. Key data memory 26*d* stores the key data necessary for encrypting the data. Data transmission among those elements is performed through bus lines 26*e* which include a first bus line connecting encryption logic circuit 26*c* and key data memory 26*d*, a second bus line connecting encryption logic circuit 26*c* and CPU 26*a*, and a third bus line connecting CPU 26*a* and data memory 26*b*.

Figure 14:
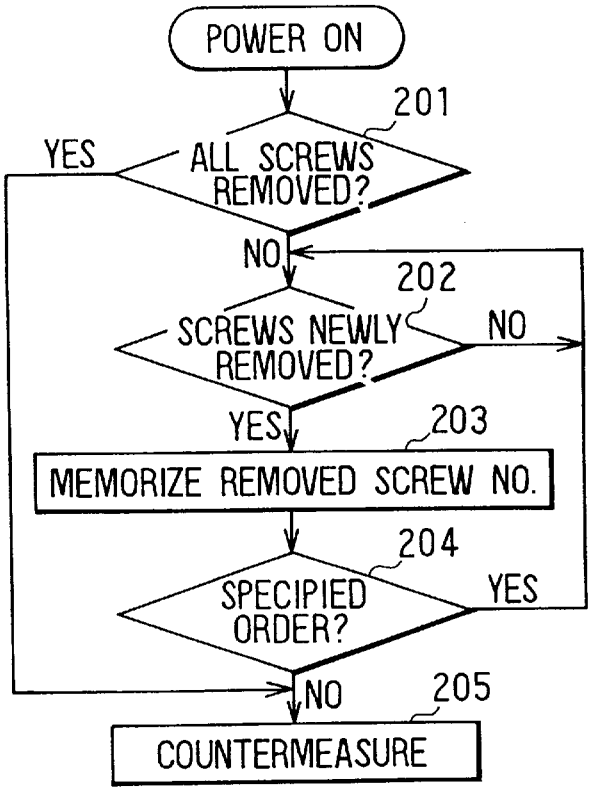
FIG. 14 is a flowchart showing steps of taking a countermeasure when the on-board device is opened.

FIG. 14 shows a process to detect the screw removal from the case using the signal from switches 235. At step 201, whether all the screws are removed (circuit board 23 is dismounted and then the power switch is turned on again) is judged. If the answer is "yes," it is judged that the case is illegitimately opened and the process proceeds to step 205 where the countermeasure (setting a flag or erasing data to make the on-board device inoperative as explained above) is taken. If the answer from step 201 is "no," whether any screw is removed thereafter is judged at step 202. If there are newly removed screws, the removed screw number (each screw is numbered from 1 to 4 beforehand) is memorized at step 203. Then, whether the screws are removed in a predetermined order (for example, No.1 screw→No.3 screw→No.2 screw→No.4 screw) is judged at step 204. If the screws are removed in the predetermined order, it is judged that on-board device 20 is opened legitimately for the purpose of maintenance or other reasons, and the process returns to step 202. If step 204 judges that the screws are removed in an order other than the predetermined order, it is judged that on-board device 20 is opened illegitimately. Then, the process proceeds to step 205 where the countermeasure against such an illegitimate action is taken. In other words, there are two situations which are judged as the illegitimate action. One is the situation where circuit board 23 is taken out from the case and the power is turned on again. The other is the situation where the screws are removed in an order other than the predetermined order without turning off the power. In both situations, the countermeasure for making on-board device inoperative is taken. On the other hand, when the screws are removed in the predetermined order, such countermeasure is not taken. Accordingly, no recovery process is unnecessarily required when the case is opened legitimately for the purpose of maintenance or repair.

Figure 15A:
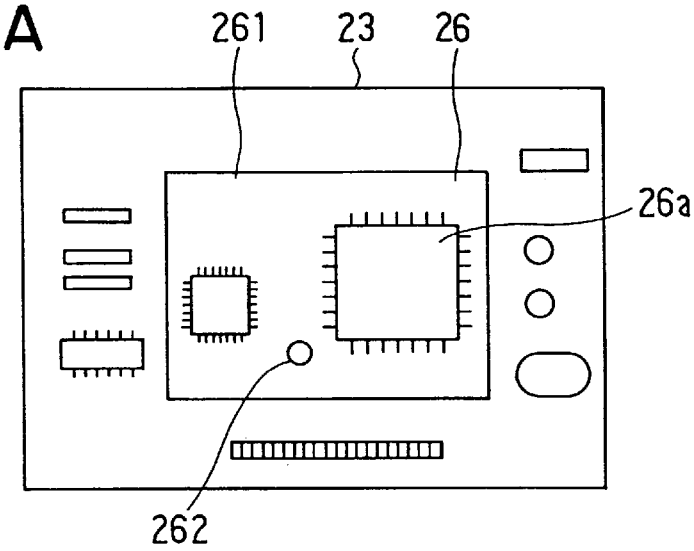
FIG. 15A is a plan view schematically showing a modified circuit board.
Figure 15B:
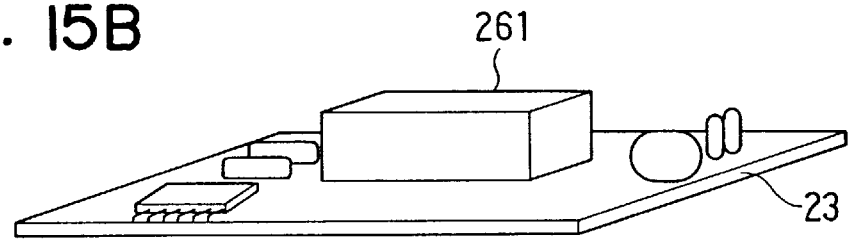
FIG. 15B is a perspective view showing the circuit board shown in FIG. 15A.
Figure 16:
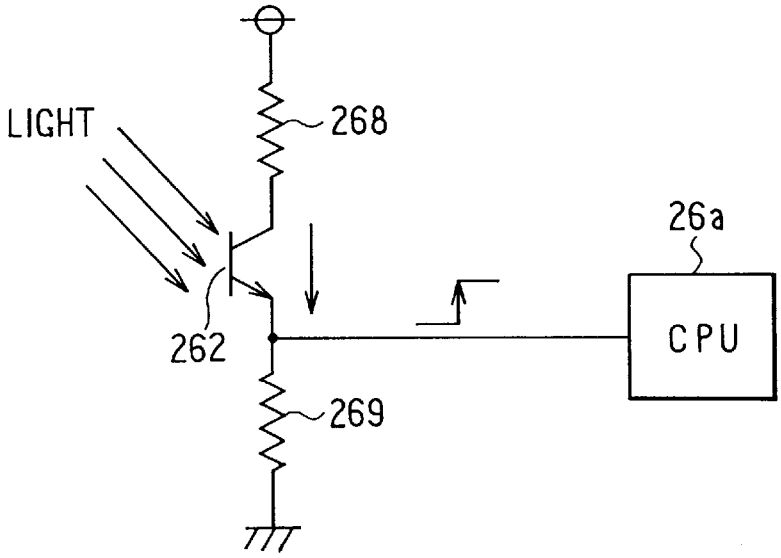
FIG. 16 is a diagram showing a circuit for detecting light when the on-board device is opened.
Figure 17:
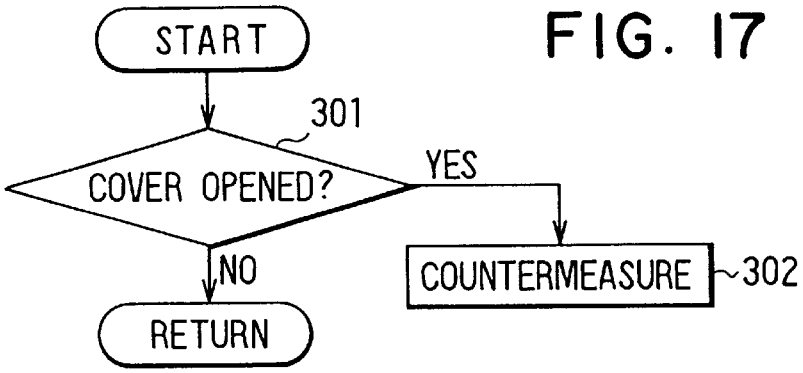
FIG. 17 is a flowchart showing steps of taking a countermeasure when opening of the on-board device is found by the circuit shown in FIG. 16.
Figure 18:
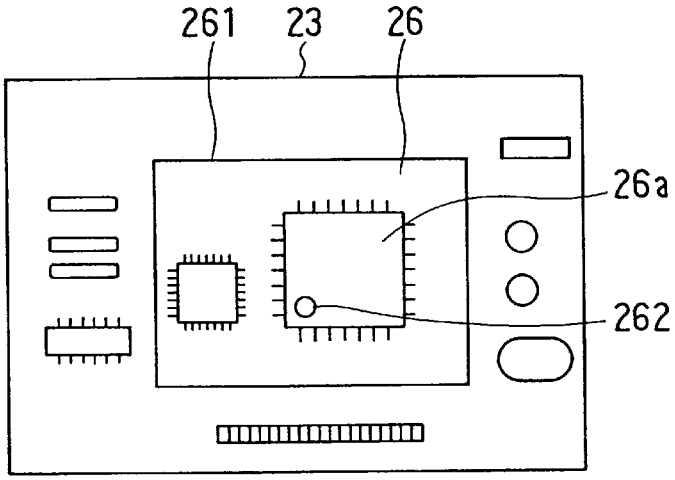
FIG. 18 is a plan view schematically showing another modification of the circuit board.

The illegitimate actions can be detected by some other ways. One example is shown in FIGS. 15A to 17. FIG. 15A shows a schematic plan view of circuit board 23, and FIG. 15B shows a perspective view thereof. Cover 261 is disposed on circuit board 23 to contain therein control circuit 26 having CPU and other elements for which security protection is necessary. Photo-diode 262 disposed on circuit board 23 is also covered by cover 261. Cover 261 is fixed to circuit board 23 by an adhesive material. Photo-diode 262 is connected to resistors 268, 269 and CPU 26*a* as shown in FIG. 16. When cover 261 is opened, electric current flowing through photo-diode 262 is increased by light emitted to photo-diode 262, and thereby the opening of cover 261 is detected by CPU 26*a*. FIG. 17 shows a process in which the opening of the cover is detected and the countermeasure against such opening is taken. At step 301, whether cover 261 is opened is judged. If the answer is "yes," the countermeasure against such an action is taken at step 302. If the answer sis "no," the process is returned. Because cover 261 covers only the components for which security protection is required, other components on the circuit board 23 can be freely repaired without opening cover 261. Photo-diode 262 may be mounted on CPU chip 26*a* as shown in FIG. 18.

To further enhance the security protection for on-board device 20 in addition to the protection mentioned above, control circuit 26 shown in FIG. 13 may be made into a single chip. Control circuit 26 shown in FIG. 13 includes separate components connected to each other by bus lines 26*e*. There is a possibility that the data for which security protection is required could be read by placing a probe on bus lines 26*e* before the data are encrypted. When all the components are made in a single chip and outside bus lines 26*e* are eliminated, such probing is not possible, and thereby the security protection is enhanced.

Figure 19:
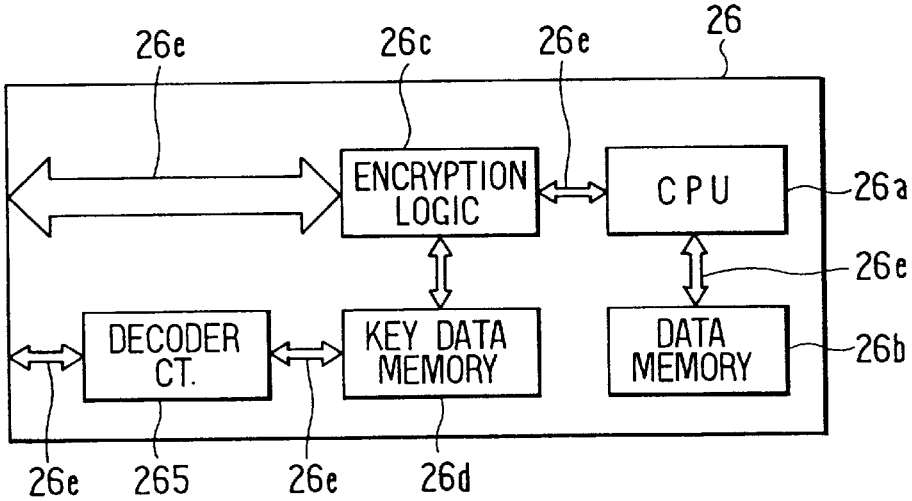
FIG. 19 is a block diagram showing another example of the circuit board.

If the key data for use in encryption stored in control circuit 26 is stolen, the data under security protection can be read through an interface outside of control circuit 26. Therefore, it is preferable to make the key data variable. For this purpose, various key data may be stored in key data memory 26*d* and also in stationary device 60. The key data to be commonly used in the communication between on-board device 20 and stationary device 60 may be selected at random from among the various key data. Further, decoder circuit 265 as shown in FIG. 19 may be added to control circuit 26, so that the key data sent from stationary device 60 to on-board device 20 are decoded and used as a key for data encryption.

While the present invention has been shown and described with reference to the foregoing preferred embodiment, it will be apparent to those skilled in the art that changes in form and detail may be made therein without departing from the scope of the invention as defined in the appended claims.

What is claimed is:

1. A communication system for use in an electronic toll collection system in which a toll is electronically collected through wireless communication between an on-board electronic device and a stationary electronic device, the communication system comprising:

means for detecting an illegitimate action committed in the electronic toll collection system, said detecting means being a component of said on-board device;

means, electrically connected to the detecting means, for temporarily terminating the wireless communication between the on-board electronic device and the stationary electronic device when the illegitimate action is detected by the detecting means; and means, including a programmer separate from the on-board electronic device, for recovering the wireless communication between the on-board electronic device and the stationary electronic device.

2. The communication system as in claim 1, wherein:

the temporarily terminating means includes a memory containing original data which are altered when the illegitimate action is detected by the detecting means;

the wireless communication remains terminated during a period in which the memory remains altered; and the recovering means restores the original data in the memory whereby the wireless communication is recovered.

3. The communication system as in claim 2, wherein:

the data in the memory are altered by eliminating data necessary for the wireless communication; and the original data are restored by rewriting the eliminated data.

4. The communication system as in claim 2, wherein:

the data in the memory are altered by setting a flag in the memory which indicates a temporary termination of the wireless communication; and the wireless communication is recovered by resetting the flag.

5. The communication system as in claim 1, wherein the illegitimate action is opening the on-board electronic device illegitimately.

6. The communication system as in claim 1, wherein the illegitimate action is reading the data stored in the memory illegitimately.

7. The communication system as in claim 1, further comprising means for recording an accumulated number of the illegitimate action committed.

8. The communication system as in claim 7, wherein:

the wireless communication is made unrecoverable when the accumulated number of the illegitimate action committed exceeds a predetermined number.

9. The communication system as in claim 1, wherein:

the wireless communication is performed under encryption;

the on-board electronic device includes a key memory containing various key data for encryption and decryption; and the key data used in the wireless communication are selected from the various key data at random every time the wireless communication is performed.

10. The communication system as in claim 9, wherein:

the key data used in the encrypted wireless communication are first selected at the stationary electronic device and sent to the on-board electronic device which decodes the key data.

11. The communication system as in claim 1, wherein:

the on-board electronic device includes electronic components which require security protection against an illegitimate access thereto and electronic components which require maintenance service; and the electronic components requiring security protection are formed as a single chip in which all of such components are connected by an inner bus line.

12. The communication system as in claim 11, wherein the single chip containing the electronic components requiring security protection is mounted on a single circuit board separate from the electronic components requiring maintenance service.

13. The communication system as in claim 12, wherein the single chip is covered by a cover case, and a photo-diode is disposed in the cover case so that the photo-diode detects opening of the cover case.

14. The communication system as in claim 1, wherein the programmer includes an electromagnetically shielded box for containing the on-board electronic device therein for recovering a temporarily terminated communication function of the on-board electronic device and a computer for communicating with the on-board electronic device contained in the shielded box.

15. An on-board electronic device having a communication function for use in an electronic toll collection system in which a toll is electronically collected through wireless communication between the on-board electronic device and a stationary electronic device, the on-board electronic device comprising:

means for detecting an illegitimate action committed in the electronic toll collection system;

means, electrically connected to the detecting means, for temporarily terminating the communication function of the on-board device when the illegitimate action is detected by the detecting means;

means for recovering the communication function of the on-board device;

a circuit board carrying electronic components thereon; and a case containing the circuit board therein, wherein:

the illegitimate action is opening the case illegitimately;

the circuit board is fastened to the case with a plurality of screws; and removal of the screws from the circuit board in an order other than a predetermined order is judged as the action illegitimately opening the on-board electronic device.

16. The on-board electronic device as in claim 15, wherein:

each screw fastening the circuit board to the case constitutes an electric switch which turns on when the screw fastens the circuit board to the case and turns off when the screw is removed from the circuit board.

* * * * *